US008134506B2

(12) United States Patent
Leisten

(10) Patent No.: US 8,134,506 B2
(45) Date of Patent: Mar. 13, 2012

(54) ANTENNA ARRANGEMENT

(75) Inventor: Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 992 days.

(21) Appl. No.: 12/002,322

(22) Filed: Dec. 14, 2007

(65) Prior Publication Data

US 2009/0153413 A1 Jun. 18, 2009

Related U.S. Application Data

(60) Provisional application No. 60/921,767, filed on Apr. 3, 2007.

(30) Foreign Application Priority Data

Dec. 14, 2006 (GB) ..... 0624976.7

(51) Int. Cl.
*H01Q 1/24* (2006.01)

(52) U.S. Cl. ..... 343/702; 343/895

(58) Field of Classification Search ..... 343/702, 343/753, 844, 895, 793
See application file for complete search history.

(56) References Cited

U.S. PATENT DOCUMENTS

| | | | |
|---|---|---|---|
| 3,599,220 | A | 8/1971 | Dempsey |
| 4,008,479 | A | 2/1977 | Smith |
| 4,554,554 | A | 11/1985 | Olesen et al. |
| 4,608,574 | A | 8/1986 | Webster et al. |
| 5,191,352 | A | 3/1993 | Branson |
| 5,346,300 | A | 9/1994 | Yamamoto et al. |
| 5,349,365 | A | 9/1994 | Ow et al. |
| 5,635,945 | A | 6/1997 | McConnell et al. |
| 5,838,282 | A | 11/1998 | Lalezari et al. |
| 5,854,609 | A | 12/1998 | Pyo et al. |
| 5,945,963 | A | 8/1999 | Leisten |
| 5,963,180 | A | 10/1999 | Leisten |
| 6,011,524 | A | 1/2000 | Jervis |
| 6,031,495 | A | 2/2000 | Simmons et al. |
| 6,094,178 | A | 7/2000 | Sanford |
| 6,133,891 | A | 10/2000 | Josypenko |
| 6,150,984 | A | 11/2000 | Suguro et al. |
| 6,229,488 | B1 | 5/2001 | Lin et al. |
| 6,229,499 | B1 | 5/2001 | Licul et al. |
| 6,232,929 | B1 | 5/2001 | Ermutlu et al. |
| 6,281,859 | B1 | 8/2001 | Winter et al. |

(Continued)

FOREIGN PATENT DOCUMENTS

CN 2899134 Y 5/2007

(Continued)

OTHER PUBLICATIONS

International Search Report from PCT/GB2007/004748, Jul. 30, 2008.

(Continued)

*Primary Examiner* — Dieu H Duong
(74) *Attorney, Agent, or Firm* — John Bruckner PC

(57) ABSTRACT

An antenna arrangement which includes two antennas which are resonant at a common operating frequency. The arrangement includes a circuit which combines output signals from each of the antennas to provide a combined signal output. Each antenna has an electrically insulative core of solid material having a relative dielectric constant greater than 5 and a three-dimensional antenna element structure. The structure includes at least a pair of elongate conductive antenna elements disposed on or adjacent a surface of the core.

18 Claims, 7 Drawing Sheets

U.S. PATENT DOCUMENTS

| | | | | |
|---|---|---|---|---|
| 6,300,917 | B1 | 10/2001 | Leisten et al. | |
| 6,369,776 | B1 * | 4/2002 | Leisten et al. | 343/895 |
| 6,384,798 | B1 | 5/2002 | Barta et al. | |
| 6,476,776 | B1 | 11/2002 | Kurby | |
| 6,480,173 | B1 | 11/2002 | Marino | |
| 6,531,985 | B1 * | 3/2003 | Jones et al. | 343/702 |
| 6,552,693 | B1 | 4/2003 | Leisten | |
| 6,690,336 | B1 | 2/2004 | Leisten et al. | |
| 6,765,541 | B1 | 7/2004 | Josypenko | |
| 6,886,237 | B2 | 4/2005 | Leisten et al. | |
| 6,914,580 | B2 | 7/2005 | Leisten | |
| 7,256,752 | B2 | 8/2007 | Wither et al. | |
| 2002/0055336 | A1 * | 5/2002 | Hong | 455/90 |
| 2002/0113731 | A1 | 8/2002 | Strickland | |
| 2006/0067419 | A1 | 3/2006 | Sandhu | |

FOREIGN PATENT DOCUMENTS

| | | | |
|---|---|---|---|
| EP | 0469741 | | 2/1992 |
| EP | 0528175 | A | 2/1993 |
| EP | 1076378 | | 2/2001 |
| EP | 1306921 | A | 5/2003 |
| FR | 2888675 | | 1/2007 |
| GB | 587627 | A | 5/1947 |
| GB | 2202638 | | 9/1988 |
| GB | 2282487 | A | 4/1995 |
| GB | 2292257 | | 2/1996 |
| GB | 2292638 | A | 2/1996 |
| GB | 2310543 | A | 8/1997 |
| GB | 2311675 | | 10/1997 |
| GB | 2338605 | A | 12/1999 |
| GB | 2351850 | A | 1/2001 |
| GB | 2367429 | A | 4/2002 |
| GB | 2389234 | | 12/2003 |
| GB | 2401994 | | 11/2004 |
| GB | 2424521 | | 9/2006 |
| GB | 2430556 | | 3/2007 |
| GB | 2419037 | A | 4/2008 |
| JP | 02278901 | | 11/1990 |
| JP | 2004040596 | | 2/2004 |
| TW | I238566 | | 7/1993 |
| TW | M276332 | | 2/2005 |
| TW | I248230 | | 1/2006 |
| WO | WO 99/26316 | | 5/1999 |
| WO | WO 9931820 | A | 6/1999 |
| WO | WO 0048268 | | 8/2000 |
| WO | WO 03044895 | | 5/2003 |
| WO | WO 2006136809 | | 12/2006 |
| WO | WO 2006136810 | | 12/2006 |

OTHER PUBLICATIONS

Written Opinion of the International Searching Authority from PCT/GB2007/004748, Jul. 30, 2008.

International Preliminary Report on Patentability from PCT/GB2007/004748, Jun. 16, 2009.

* cited by examiner

ANTENNA ARRANGEMENT

CROSS-REFERENCES TO RELATED APPLICATIONS

This application claims a benefit of priority under 35 U.S.C. 119(e) from provisional patent application U.S. Ser. No. 60/921,767, filed Apr. 3, 2007, the entire contents of which are hereby expressly incorporated herein by reference for all purposes. This application is related to, and claims a benefit of priority under one or more of 35 U.S.C. 119(a)-119(d) from copending foreign patent application 0624976.7, filed in the United Kingdom on Dec. 14, 2006 under the Paris Convention, the entire contents of which are hereby expressly incorporated herein by reference for all purposes.

BACKGROUND INFORMATION

1. Field of the Invention

This invention relates to an antenna arrangement for operation at frequencies in excess of 200 MHz, and to a mobile terminal including the antenna arrangement.

2. Discussion of the Related Art

GB-A-2292638, GB-A-2309592 and GB-A-2311675 all disclose examples of dielectrically-loaded antennas having certain common features. Each antenna includes a solid cylindrical ceramic core of high relative dielectric constant, a coaxial feeder passing through the core on its axis to a termination at a distal end, a conductive sleeve plated on a proximal portion of the core, and a plurality of elongate helical conductor elements plated on the cylindrical surface of the core and extending between radial connections with the feeder termination on the distal end face and the rim of the sleeve. The combination of the conductive sleeve and an outer sleeve of the coaxial feeder form a quarterwave balun which creates an at least approximately balanced condition at the connection between the feeder and the radial connections at the distal end of the core.

GB-A-2292638 discloses a quadrifilar backfire antenna having four elongate helical elements formed as two pairs, the electrical length of the elements of one pair being different from the electrical length of the elements of the other pair. This structure has the effect of creating orthogonally phased currents at an operating frequency of, for example, 1575 MHz with the result that the antenna has a largely omni-directional radiation pattern for circularly polarised signals such as those transmitted by the satellites in the GPS (Global Positioning System) satellite constellation.

GB-A-2309592 discloses an antenna having a single pair of diametrically opposed helical elements forming a twisted loop yielding a radiation pattern which is omni-directional with the exception of nulls centred on a null axis extending perpendicularly to the cylindrical axis of the antenna. This antenna is particularly suitable for use in a portable telephone, and can be dimensioned to produce loop resonances at frequencies respectively within the European GSM band (890 to 960 MHz) and the DCS band (1710 to 1880 MHz), for example. Other relevant bands include the American AMPS (842 to 894 MHz) and PCN (1850 to 1990 MHz) bands.

GB-A-2311675 discloses the use of an antenna having the same general structure as that disclosed in GB-A-2202638 in a dual service system such as a combined GPS and mobile telephone system, the antenna being used for GPS reception when resonant in a quadrifilar (circularly polarised) mode and for telephone signals when resonant in a single-ended (linearly polarised) mode.

SUMMARY OF THE INVENTION

It is has been found by the applicant that for most applications the core of an antenna such as those described above having a diameter of 10 mm provides the required efficiency. In particular, antennas suitable for L-band GPS reception at 1575 MHz have a diameter of about 10 mm and the longitudinally extending antenna elements have an average longitudinal extent of about 12 mm. At 1575 MHz, the length of the conductive sleeve is typically in the region of 5 mm. The diameter of the coaxial feed structure in the bore is in the region of 2 mm. Other dielectrically-loaded antennas disclosed by the applicant have similar dimensions, and for most applications have a diameter of about 10 mm.

The above-noted antennas are particularly suitable for use in small hand-held devices not only due to their small size, but also because they do not experience appreciable detuning when placed close to objects such as the human body. Hitherto, antennas having a diameter of 10 mm have been small enough to fit in most mobile devices. As with other types of portable devices, one of the main design criteria is miniaturisation. Thus, mobile device manufacturers envisage requiring dielectrically-loaded antennas having widths of less than 10 mm. However, reducing the size of a dielectrically loaded antenna such as those described above significantly reduces the efficiency of the antenna. This is because, to a first approximation, efficiency is proportional to radiation resistance which, in turn, is inversely proportional to the square of the diameter.

It is an object of the present invention to mitigate or avoid a reduction in antenna efficiency in mobile devices of reduced dimensions.

According to a first aspect of the present invention, an antenna arrangement comprises at least two antennas each resonant at a common operating frequency, and a circuit arranged to combine output signals from each of the said antennas at the said frequency to provide a combined signal output, wherein each antenna comprises: an electrically insulative core of solid material having a relative dielectric constant greater than 5, and a three-dimensional antenna element structure including at least a pair of elongate conductive antenna elements disposed on or adjacent a surface of the core.

Such an arrangement has a larger effective aperture for electromagnetic radiation when compared with an arrangement having a single antenna of similar dimensions. As a result, efficiency is improved to the extent that an antenna arrangement in accordance with the invention may use antennas having smaller diameters than corresponding single antenna arrangements.

Preferably the combining circuit comprises an output node and a plurality of arms, each arm being connected between a respective antenna and the output node. Typically, each antenna comprises a feed connection coupled to respective first ends of the arms, the other ends of the arms constituting the output node. In the preferred embodiment of the invention, the combining circuit is configured such that each feed connection is isolated from each other feed connection at the operating frequency, this typically being achieved by arranging for each arm to comprise a phase-shifting and impedance transforming element for effecting a 90° phase-shift between the ends of the arm at the operating frequency and for stepping up the impedance presented by the respective antenna and any interposed network at the feed connection of the antenna, such phase-shifting and impedance-transforming elements being interconnected at the feed connections by a cancelling resistance between each pair of elements. The value of the resistance is preferably chosen such that, at each feed connection of a pair of feed connections, a voltage component present at that feed connection as a result of a signal at the other feed connection of the pair being transmitted through the two arms via the output node is equal in magnitude and opposite in phase to another voltage component transmitted from the source feed connection via the cancelling resistance. It follows that the resulting voltage, being the sum of the two components, is substantially zero. Consequently, the antenna feed connections are isolated from each other. The phase-shifting and impedance-transforming elements may be quarterwave transmission line sections or lumped components. In the case of them being quarterwave transmission line sections, they are preferably microstrip lines which, in the case of an arrangement having two antennas, typically have a characteristic impedance of about $\sqrt{2}\times$ the output impedance of the combining circuit. Thus, if the output impedance is 50 ohms, the characteristic impedance of the transmission line sections is about 71 ohms.

In the preferred embodiment, the arrangement comprises two antennas which are each connected by a microstrip transmission line to the output node. A single resistor is connected between the feed connections of the antennas.

The core of each antenna is preferably a cylinder having a length of coaxial feeder passing along its axis and terminating at a distal end of the core. The coaxial feeder has an inner conductor and an outer shield conductor which are separated byan insulative sheath. A conductive sleeve is plated around a proximal end of the core and is coupled to the shield conductor of the coaxial feeder at the proximal end of the core. The elongate conductive antenna elements are preferably helical tracks which extend from a connection with the coaxial feeder at the distal end of the core, to a connection with the rim of the conductive sleeve on the cylindrical surface of the core. The conductive sleeve acts in combination with the feeder as a balun to promote a substantially balanced condition at the connection between the coaxial feeder and the helical elements.

The antennas generally share substantially the same dimensions and are preferably identical. The antennas of the arrangement are preferably positioned such that the axis of each antenna is parallel to the axis of the other antenna and such that first and second end faces of the antennas lie substantially in common first and second planes.

The axes of the antennas are typically closer together than half a wavelength at the operating frequency (approximately 9.5 cm at 1575 MHz) in order substantially to avoid problems with diffraction patterns. Advantageously, the cylindrical surfaces of the antennas are at least 0.05 $\lambda$ apart to avoid excessive coupling between the antennas, $\lambda$ being the wavelength in air at the operating frequency. This range of inter-antenna spacings lends the arrangement to a variety of devices, especially handheld devices such as cellphones.

It is particularly advantageous that the arrangement comprises a pair of substantially identical helical antennas each having a respective central axis, with the two axes parallel and spaced apart, the two antennas further having the same axial position as each other, and the rotational positions of the antennas about their respective axes differing by 180°. This has the effect of causing charge summation in the space between the antennas, with benefits to the radiation pattern of the arrangement as a whole.

This may be understood more clearly by considering the effect of having two antennas with the same orientation placed close together and driven at their feed connections by signals having the same phase. As the two antennas are moved progressively closer to each other, the first observable effect is that the radiation patterns of the individual antennas are distorted. In the case of two antennas for circularly polarised radiation, the cause of this effect can be visualised by considering two rotating dipoles in the near-field. If, at an instant that the dipoles are aligned along a line connecting the two antennas, then, providing the antennas are similar and similarly oriented, the electric charges in the space between the antennas will tend to cancel, reducing the overall charge concentration in the central region so that the combined charge pattern at the given instant resembles a single dipole across the pair of antennas. The consequence of this is that the combined circular polarisation pattern is impaired. This impairment can be mitigated by orienting the antennas differently, as described above. Now, with the new orientations, the two charge dipoles at a given instant are in opposition when aligned alone the line of connection between the antennas. It is, therefore, possible, using this feature, to place the antennas closer together than would otherwise be practicable whilst maintaining the required performance in terms of radiation pattern.

Since, for a circularly polarised wave incident upon such an antenna arrangement in the direction of the axes, the respective signals fed from the antennas differ in phase by 180°, the preferred arrangement has a halfwave delay line connected between the feed connection of one of the antennas and its associated quarterwave transmission line of the combining circuit.

According to a further aspect, the present invention provides a mobile terminal comprising the above antenna arrangement.

According to a further aspect of the invention, a mobile terminal comprises two antennas for operation at frequencies in excess of 200 MHz, the antennas each comprising an electrically insulative core of solid material having a dielectric constant greater than 5, a three-dimensional antenna element structure having at least a pair of antenna elements, and a feed connection, wherein the mobile terminal further comprises a circuit arrangement which couples the feed connections to a common output node, and isolates each feed connection from the other feed connection, thereby to provide a combined signal output.

According to yet a further aspect, the invention provides an antenna assembly for a handheld radio signal receiver, comprising: at least two dielectrically loaded antennas each resonant at a common operating frequency and each comprising an insulative core of a solid dielectric material which has a relative dielectric constant greater than 5 and which occupies the major part of the volume and defined by the outer surfaces of the core, a three dimensional antenna element structure including at least a pair of elongate conductive antenna elements disposed on or adjacent an outer surface of the core, and an output connection coupled to the antenna element structure; and a signal combiner coupled to the respective output connections of the antennas and arranged to combine signals present at the output connections at the said common operating frequency to provide a combined signal output; the antennas being mounted in a spaced-apart relationship in the assembly.

According to yet a further aspect, the invention provides a portable clamshell terminal comprising a body portion housing a microphone and having an inner face, a cover portion housing an earphone, and, associated with an edge of the body portion, a hinge arrangement connecting the cover portion to the body portion to allow the cover portion to be pivoted between an open position in which the inner face is exposed and a closed position in which it covers the inner face, the terminal further comprising at least two dielectrically-loaded antennas each having a central axis, and a combiner circuit for combining signals received by the two antennas, the antennas being mounted in the body portion in the region of the hinge arrangement with their central axes parallel to each other and generally parallel to the inner face of the body portion, the antennas being in a side-by-side configuration in which they are spaced apart in the direction of the hinge axis.

Typically, the spacing between the antennas, at their closest points, is between 10 mm and 40 mm, to suit the styling of the terminal.

Preferably, the hinge arrangement comprises two axially spaced-apart hinge parts associated with respective sides of the body portion and having a common hinge axis, and the antenna arrangement comprises a pair of antennas located between the hinge parts.

According to yet a further aspect, the present invention provides a portable clamshell terminal having a body portion and a cover portion hinged to the body portion, and a pair of dielectrically loaded helical antennas each resonant at a common operating frequency and each having a respective axis of symmetry, wherein the antennas are mounted in the region of the hinge axis and in a spaced-apart side-by-side configuration with their axes parallel.

The antenna arrangement described above can serve for signal transmission as well as signal reception. Accordingly, the invention also provides an antenna arrangement for a portable terminal, comprising: at least two antennas each resonant at a common operating frequency, and a circuit arranged to split an input signal into substantially identical split signals and to feed the split signals to each of the antennas, wherein each antenna comprises: an electrically insulative core of a solid material having a relative dielectric constant greater than 5, and a three-dimensional antenna element structure including at least a pair of elongate conductive antenna elements disposed on or adjacent a surface of the core.

BRIEF DESCRIPTION OF THE DRAWINGS

The invention will now be described by way of example with reference to the drawings in which.

DESCRIPTION OF PREFERRED EMBODIMENTS

Figure 1A:
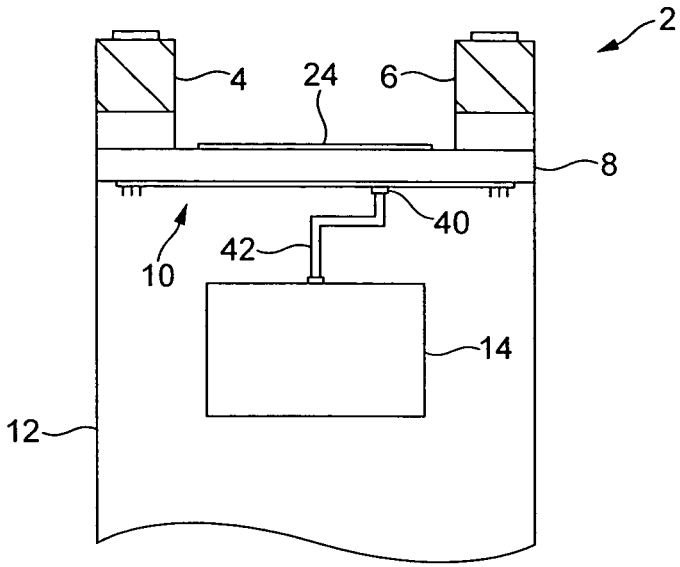
FIGS. 1A to 1C are diagrams of a part of a mobile terminal incorporating a first antenna arrangement in accordance with the present invention.
Figure 1B:
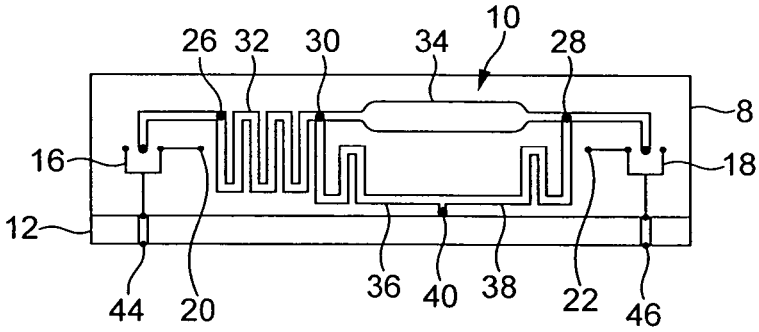
Figure 1C:
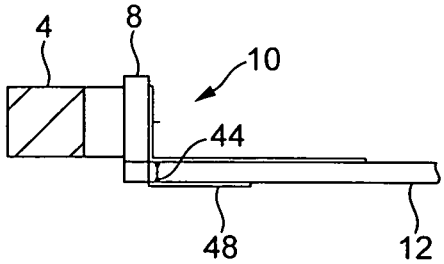

Referring to FIGS. 1A to 1C, an antenna arrangement 2 in accordance with the invention includes two antennas 4, 6 which are mounted on an antenna-mounting printed circuit board (PCB) 8 (or other suitable board). The PCB 8 is elongate, and antennas 4, 6 are mounted at either end. A combining circuit 10 is located on the underside of the PCB 8, that is to say, the side opposing that on which the antennas are mounted. The PCB 8 is mounted perpendicularly to a device PCB 12. A receiver 14 is mounted on the device PCB 12. The antennas are coupled to the combining circuit 10 which is coupled to receiver 14. The antenna arrangement will be described in more detail below.

The antennas 4, 6 are identical and are quadrifilar dielectrically-loaded antennas.

Figure 2:
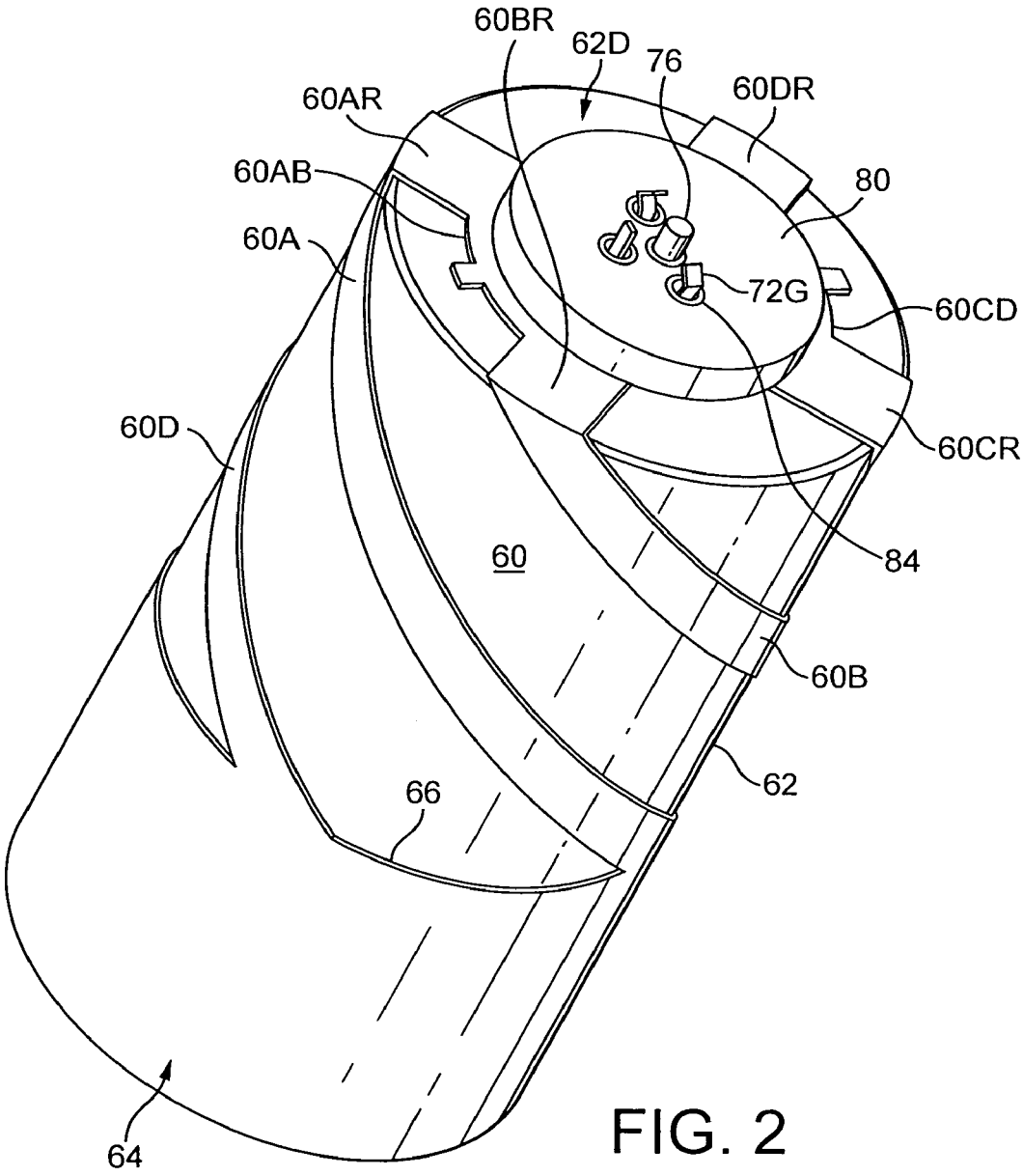
FIG. 2 is a perspective view of an antenna which forms part of the antenna arrangement shown in FIG. 1, viewed from above and one side.
Figure 3:
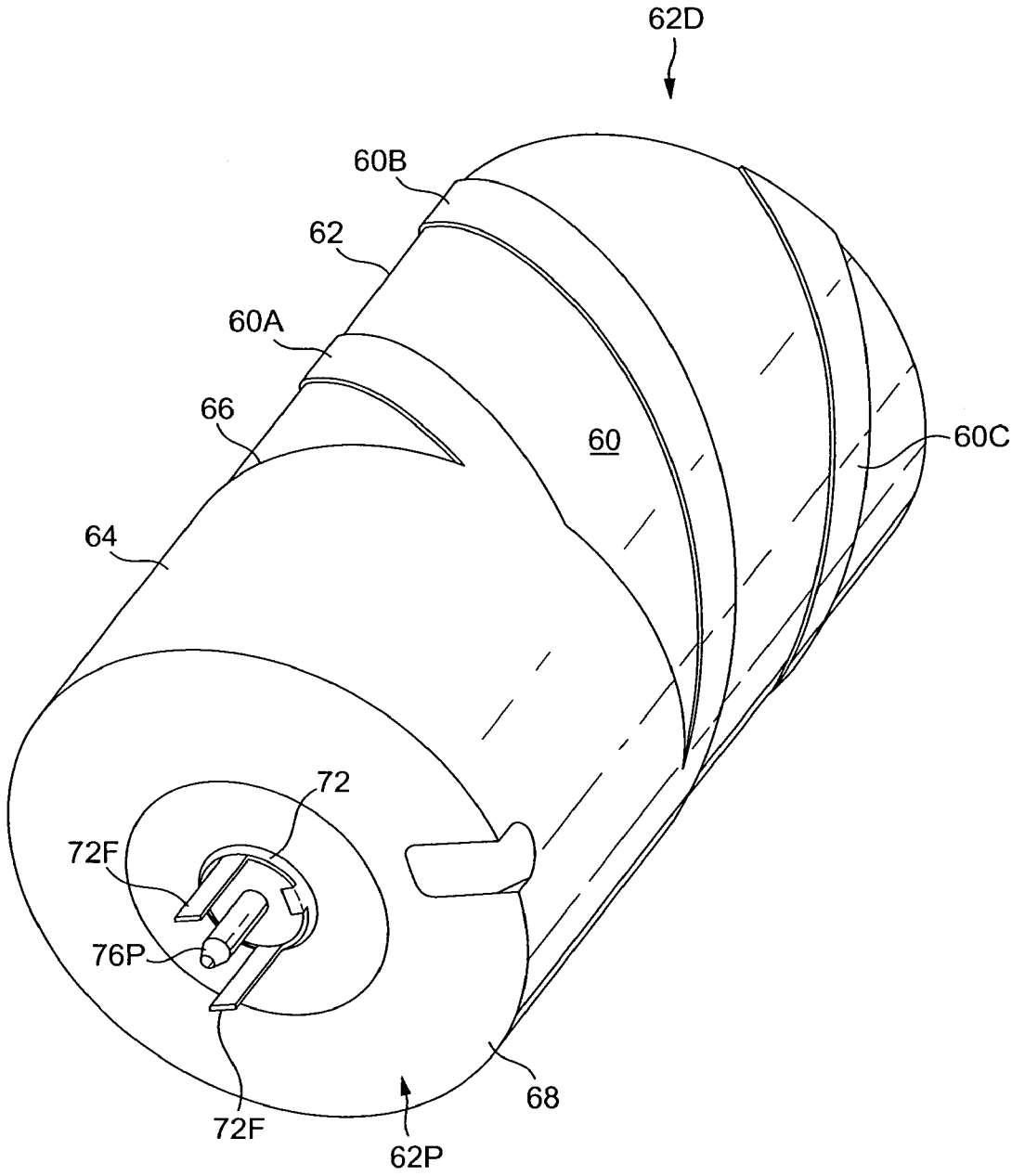
FIG. 3 is another perspective view of the antenna shown in FIG. 2, viewed from below and one side.
Figure 4:
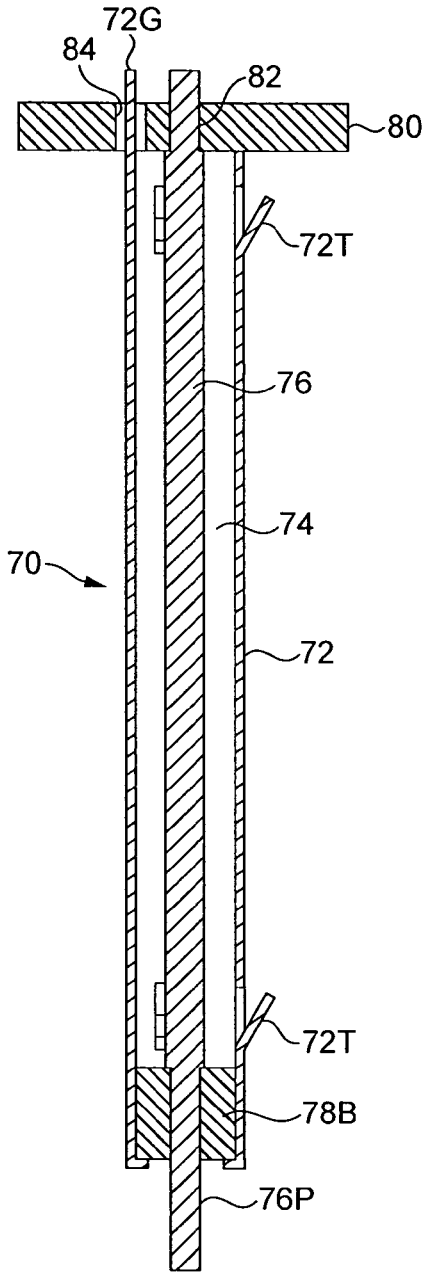
FIG. 4 is a longitudinal cross-section of a feed structure of the antenna of FIGS. 2 and 3.

Referring to FIGS. 2 and 3, the antenna 60 includes a cylindrical core 62 of electrically insulative material having a dielectric constant greater than 5. The antenna comprises an antenna element structure with four axially coextensive helical tracks 60A, 60B, 60C, 60D plated or otherwise metallised on the cylindrical outer surface of the cylindrical ceramic core 62. The core has an axial passage in the form of a bore (not shown) extending through the core 62 from a distal end face 62D to a proximal end face 62P. Both of these faces are planar faces perpendicular to the central axis of the core. They are oppositely directed, in that one is directed distally and the other is directed proximally. Housed within the bore 62B is a coaxial feeder structure. As shown in FIG. 4, the feeder structure includes a coaxial transmission line 70 with a conductive tubular outer shield 72, a first tubular insulating layer 74, and an elongate inner conductor 76 which is insulated from the shield by layer the 74. In this case the insulating layer 74 is a first air gap. The shield 72 has outwardly projecting and integrally formed spring tangs 72T or spacers which space the shield from the walls of the bore. A second tubular air gap therefore exists between the shield 72 and the wall of the bore.

At the lower, proximal end of the feeder structure, the inner conductor 76 is centrally located within the shield 72 by an insulative bush 78B. The transmission line 70 has a predetermined characteristic impedance, here 50 ohms, and passes through the antenna core 62 for coupling distal ends of the antenna elements 60A to 60D to radio frequency (RF) circuitry of equipment to which the antenna is to be connected. The couplings between the antenna elements 60A-60D and the feeder are made via a laminate board (PCB) 80 and radial conductors associated with the helical tracks 60A to 60D, these conductors being formed as radial tracks 60AR, 60BR, 60CR, 60DR plated on the distal end face 62D of the core 62. Each radial track extends from a distal end of the respective helical track to a location adjacent the end of the bore 62B The structure of the matching assembly and its connection to the distal end of the transmission line 70 is described below. At the proximal end of the transmission line 70, the inner conductor 76 has a proximal portion 76P (see FIG. 3) which projects as a pin from the proximal face 62P of the core 62 for connection to the equipment circuitry. Similarly, integral lugs 72F on the proximal end of the shield 72 project beyond the core proximal face 62P for making a connection with the equipment circuitry ground.

A conductive sleeve 64 is plated on a proximal end of the core 62. The proximal end face 62P of the core is plated with a conductor 68 which connects the coaxial outer shield 72 on the proximal end face 62P of the core to the sleeve 64. The helical antenna elements 60A-60D, extend between the connection with the coaxial feed line at the distal end of the core 62D, and a connection with a rim 66 of the conductive sleeve 64. The conductive sleeve 64 and the outer sleeve of the coaxial feed act as an balun promoting a substantially balanced condition at the connection between the helical elements 60A-60D and the coaxial transmission line.

The four helical antenna elements 60A-60D are of different lengths, two of the elements 60B, 60D being longer than the other two 60A, 60C as a result of the rim 66 of the sleeve 64 being of varying distance from the proximal end face 62P of the core. Thus, where the shorter antenna elements 60A, 60C are connected to the sleeve 64, the rim 66 is a little further from proximal face 62P than where the longer antenna elements 10B and 10D are connected to the sleeve 20.

The differing lengths of the antenna elements 60A to 60D result in phase differences between currents in the longer elements 60B, 60D and those in the shorter elements 60A, 60C respectively when the antenna operates in a mode of resonance in which the antenna is sensitive to circularly polarised signals. Operation of quadrifilar dielectrically loaded antennas having a balun sleeve is described in more detail in GB-A-2292638 and GB-A-2310543A.

The planar laminate board 80 of the feeder structure is connected to a distal end of the line 70. The laminate board or printed circuit board (PCB) 80 lies flat against the distal end face of the core 62D, in face-to-face contact. The largest dimension of the PCB 80 is smaller than the diameter of the core 62 so that the PCB 80 is fully within the periphery of the distal end face 62D of the core 62.

The PCB 80 is in the form of a disc centrally located on the distal face 62D of the core. Its diameter is such that it overlies the inner ends of the radial tracks 60AR, 60BR, 60CR, 60DR and their respective part-annular interconnections 60AB, 60CD. The PCB 80 has a substantially central hole 82 which receives the inner conductor 76 of the coaxial feeder structure. Three off-centre holes 84 receive distal lugs 72G of the shield 72. Lugs 72G are bent or "jogged" to assist in locating the PCB 80 with respect to the coaxial feeder structure.

Figure 5:
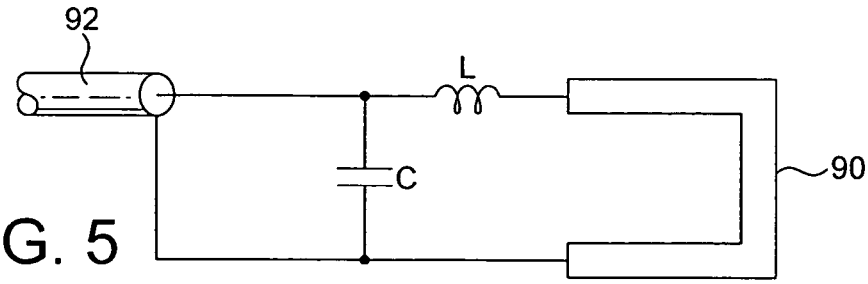
FIG. 5 is a schematic circuit diagram of the feed structure and antenna of FIGS. 3 and 4.

The PCB 80 is a multiple layer laminate board in that it has a plurality of insulative layers and a plurality of conductive layers. In this embodiment, the laminate board is arranged to provide a capacitance and an inductance between the coaxial line 70 and the antenna elements 60A, 60B, 60C, 60D, a shown in FIG. 5. Here, the antenna elements are represented by conductor 90, and the coaxial feed is represented by conductor 92. Further details of this arrangement are provided in co-pending International Patent Application No. PCT/GB2006/002257.

Referring again to FIGS. 1A to 1C in conjunction with FIG. 3, the antennas 4, 6 are mounted by their proximal end faces 62P to the antenna-mounting PCB 8. The lugs 72F and proximal inner conductor 76P pass through holes formed in PCB 8 and protrude from the underside of the PCB 8. The inner conductor 76P of antenna 4 is connected to a first circuit node 26 and the inner conductor 76P of antenna 6 is connected to a second circuit node 28. First node 26 is connected to a third circuit node 30 by a length of microstrip transmission line 32 which has a length equal to one half wavelength at the operating frequency of the device. For example, L-band GPS signals have a frequency of 1.575 GHz and a wavelength of approximately 19 cm. The length of the transmission line 32 is 9.5 cm divided by the square root of the effective relative dielectric constant, which is dependent on the dimensions of the microstrip line and the material of the substrate carrying it. A resistor 34 is connected between the third node 30 and second node 28. The resistor has a value of twice the source impedance of each antenna, and in this case has a value of 100 ohms. The circuit also comprises two quarter wavelength microstrip transmission lines 36, 38. One end of each line 36, 38 is connected to a respective one of the second and third nodes 28, 30. The other end of each transmission line is connected to an output node 40. The transmission lines 36, 38 have a characteristic impedance of $\sqrt{2}$ times the output impedance of the circuit 10, and in the present case the characteristic impedance of each of the transmission lines is typically 71 ohms.

The lugs 72F are connected to conductive track portions 16, 18 which are also connected, respectively, to through-holes 20, 22 formed on the antenna-mounting PCB 8. These through-holes are plated on their inner surfaces and are hereinafter referred to as vias. A conductor 24, formed on an upper surface of the PCB 8, is also connected to the vias 20, 22. This conductor covers an area substantially the same as the circuit 10 and is the ground-plane conductor for the microstrip transmission lines 32, 36, 38.

The output node 40 is connected to a conductive track 42 using solder which, in turn, is connected to the radio signal receiving circuit 14. The conductive tracks 16, 18 are further connected to vias 44, 46 in the device PCB 12. The vias 44, 46 are connected to a ground-plane 48 of the device PCB 12.

Figure 6:
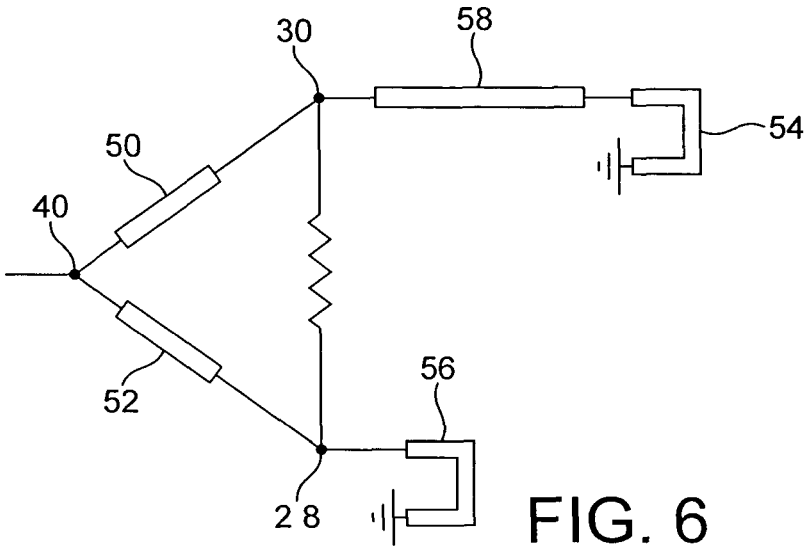
FIG. 6 is a schematic diagram of a combiner circuit of the antenna arrangement of FIGS. 1A to 1C.

Referring to FIG. 6, the microstrip transmission lines of the Wilkinson combiner are shown as quarter-wave transformers 50, 52 and the resistor connected between the third node 30 and second node 28 is shown as R. The antenna element structure of each antenna is shown respectively as 54 and 56. The phase-compensating delay line is shown as a half-wave transformer 58.

As noted above in relation to FIG. 2, two of the helical antenna elements 60B, 60D are longer than the other two helical elements 60A, 60C. This length difference is important to the antenna's ability to receive circularly polarised signals. In use, when a radio signal is received by the antenna 60, a dipole is generated across the core 62 between opposing antenna elements (e.g. 60B, 60D). This is a rotating dipole, the orientation of which, at any given instant, depends not only on time, but also on the orientation of the antenna. For a given received radio signal received by the antenna arrangement containing this antenna (as shown in FIGS. 1A-1C), rotation of the antenna by 180 degrees about its longitudinal axis will cause the dipole to be reversed in polarity.

Figure 7:
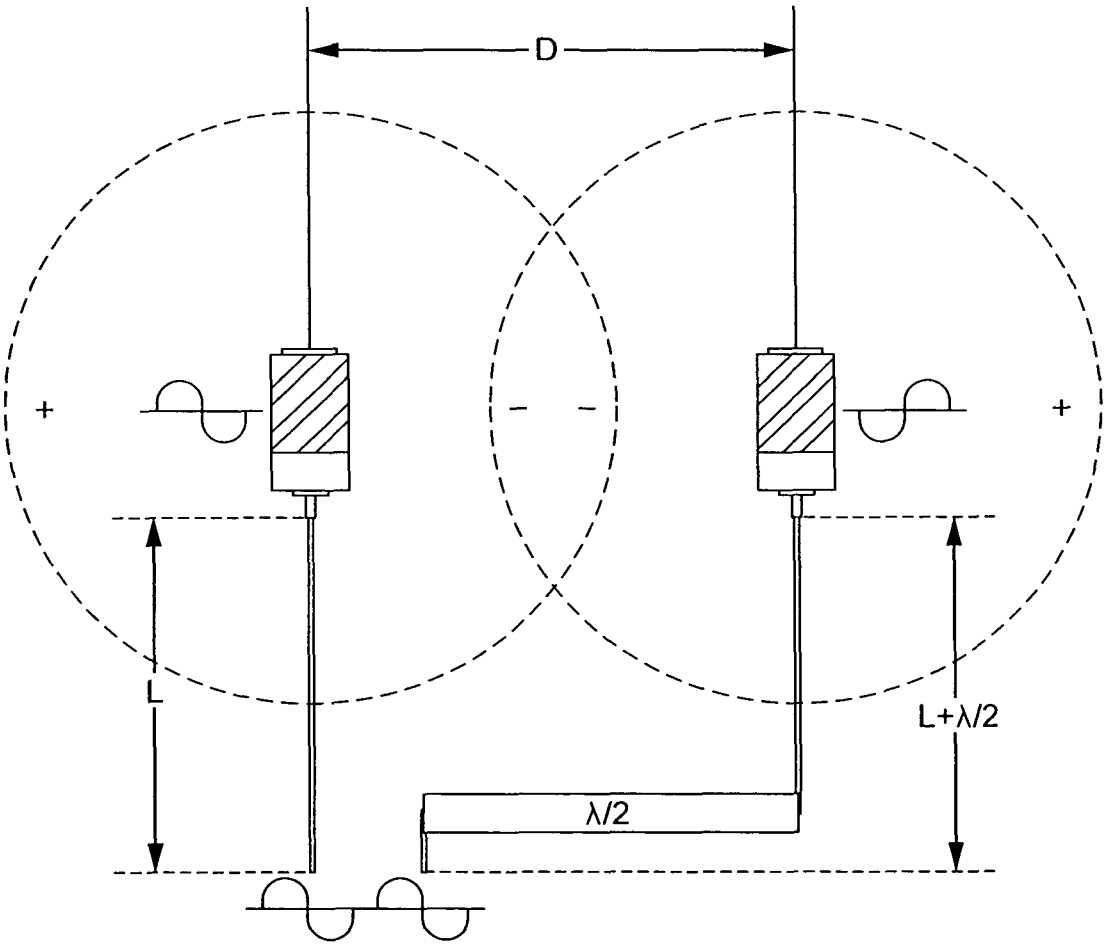
FIG. 7 is a diagrammatic representation of the radiation patterns of the antennas shown in FIG. 1A.

Referring again to FIG. 1A in conjunction with FIGS. 2 and 3, antenna 6 is oriented such that its antenna elements are at 180 degrees with respect to the corresponding antenna elements of antenna 4. In particular, antenna 4 is oriented such that its antenna elements 60C and 60C are directed towards antenna 6, and antenna 6 is oriented such that its antenna elements 60C and 60D are directed towards antenna 4. In this manner, when a radio signal is incident upon the arrangement 2, the dipoles generated in each antenna 4, 6, are polarised, at any given instant, oppositely to the dipole generated in the other antenna as shown in FIG. 7. Accordingly, the dipoles mirror each other and, therefore, charge cancellation in the space between the antennas is avoided, as described hereinbefore. This results in a combined radiation pattern which is omni-directional and which is not reduced between the antennas. It will be understood by those skilled in the art that antennas obey the law of reciprocity. Thus the phrase "radiation pattern" is used in the sense understood by those skilled in the art, that is to mean a pattern which does not necessarily represent radiated energy as it would if the antenna is connected to a transmitter, and to mean, therefore, a pattern which represents the antenna's ability to both collect and radiate electromagnetic radiation energy.

Owing to this arrangement, signals generated by the antennas 4, 6 in response to a given received radio signal are 180 degrees out-of-phase. The half-wave transmission line 32 compensates for this by delaying the signal generated by one of the antennas (antenna 4) by one half wavelength.

Figure 8A:
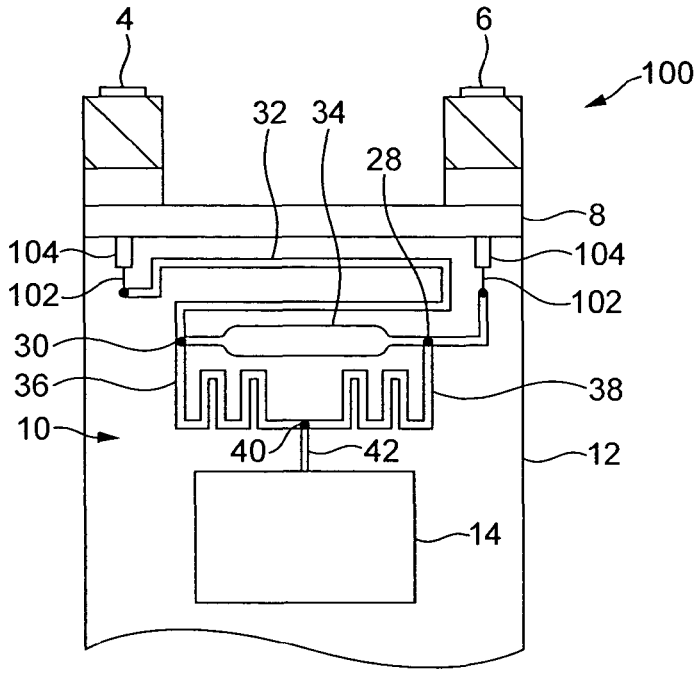
FIGS. 8A to 8C are diagrams of part of a mobile terminal including an alternative embodiment of the present invention.
Figure 8B:
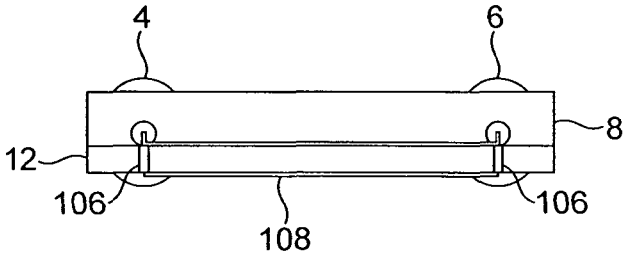
Figure 8C:
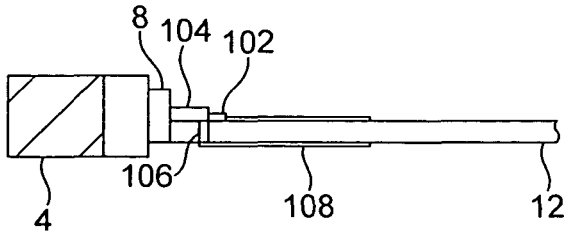

Referring to FIGS. 8A to 8C, an alternative antenna arrangement 100 in accordance with the invention is shown.

Features which it has in common with the arrangement shown in FIGS. 1A to 1C are indicated with like reference numerals. In this embodiment, the combining circuit 10 is formed on the device PCB 12 rather than on the antenna-mounting PCB 8. Each antenna 4, 6 has an alternative feed connection arrangement in which the coaxial feed line extends beyond the surface of the proximal end 62P of the antenna. The extended coaxial feed line comprises a proximal inner conductor 102 and a proximal outer conductor 104. The inner conductor 102 and the outer conductor 104 are separated by an insulator. The proximal ends of the outer conductor 104 and the insulator lie flush with each other at a short distance from the end face 62P. The inner conductor 102 extends beyond these parts of the feed connection allowing connection to external circuitry. The inner conductors 102 and outer conductors 104 are located in through-holes in the antenna-mounting PCB 8. The outer conductors 104 are connected to vias 106 in the device PCB 12 which are connected to a ground plane 108 on the underside of device PCB 12. The inner conductors 102 are coupled to conductor tracks formed on an upper surface, that is to say, the surface of the device PCB 12 opposing that on which the ground plane is formed. The combining circuit 10 is the same as that described above in relation to FIGS. 1A to 1C. The antennas 4, 6 are oriented as described above with reference to FIGS. 1A to 1C.

With reference to FIGS. 1A to 1C and 8A to 8C, the antennas have been described as being rotationally oriented at 180 degrees with respect to each other about their respective axes. In an alternative arrangement, the antennas 4, 6 are located so that the top face 62D of one antenna 4 is offset by a half wavelength above or below the top face 62D of the other antenna 6. In this arrangement, the antennas 4, 6 are not differently rotationally oriented. In other words, their rotational orientation in the mobile terminal is the same. In this arrangement, the diploes generated by each antenna are also oppositely polarised for any given received radio signal at a given axial height in the terminal. As noted above, this avoids charge cancellation between the antennas.

Figure 9:
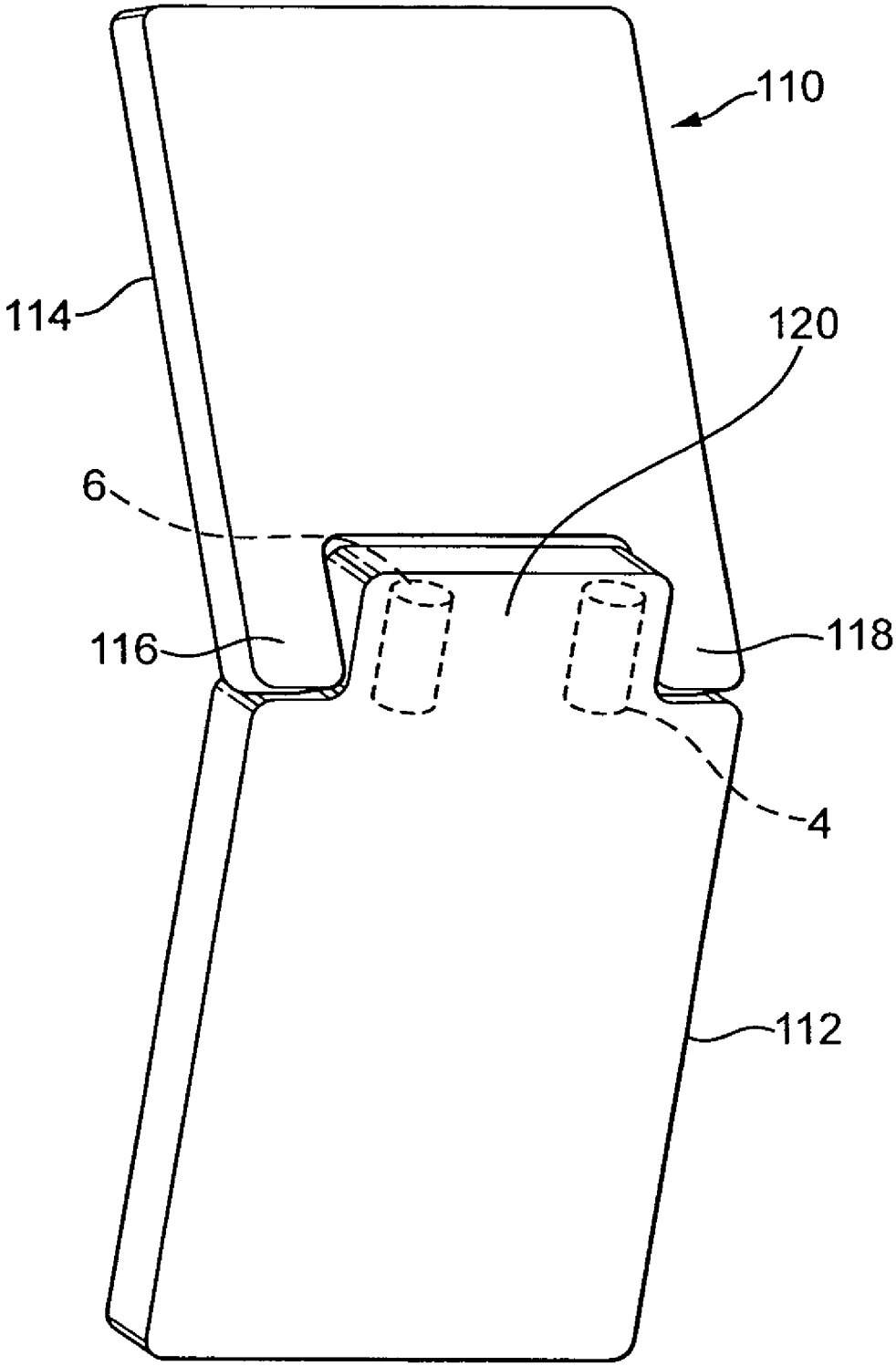
FIG. 9 is a perspective view of a portable terminal in accordance with the invention.

Referring to FIG. 9, to give an example of a mobile terminal incorporating the antenna arrangement described above with reference to FIGS. 1 to 7, a clamshell terminal 110, such as a mobile phone, is shown in an open configuration. The clamshell terminal 110 comprises a body section 112 and a cover section 114 which are interim connected by a pair of coaxial hinge parts 116, 118. The cover section 114 comprises an inner face (not shown) and typically houses a display. The body section 112 comprises an inner face (also not shown), and typically houses a keypad. The hinge parts 116, 118 are arranged to allow the cover section 114 to move between a closed configuration (not shown) on the body section 112 and the open configuration.

An antenna housing 120 is formed integrally with the body section 112 as an upper edge portion of the body section and is positioned between the hinge parts 116, 118. The two dielectrically-loaded cylindrical antennas 4, 6 are mounted at either end of the housing 120. The antennas 4, 6 are spaced apart by at least 0.05 λ apart, and in this case are about around 20 mm apart. Their distal ends are directed outwardly from the upper edge of the body section 112 so as to be directed generally skywards when the mobile phone is in use or is held with the inner face of the body section 112 upright. In particular, the antennas 4, 6 are oriented with their axes substantially parallel to the inner face of the body section 114 and defining a plane which, in addition to being parallel to the inner face, extends behind the inner face. The axes are spaced apart in a direction normal to the axes and are arranged symmetrically about a centre line of the body section 114.

The invention claimed is:

1. An antenna arrangement for a portable terminal comprising:

at least two antennas each resonant at a common operating frequency, and a circuit arranged to combine output signals from each of the said antennas at the said frequency to provide a combined signal output, wherein each antenna comprises:

an electrically insulative core of a solid material having a relative dielectric constant greater than 5, and a three-dimensional antenna element structure including at least a pair of elongate conductive antenna elements disposed on or adjacent a surface of the core.

2. The arrangement according to claim 1, wherein the combining circuit comprises an output node and a plurality of arms, each arm connected between a respective antenna and the output node, the antennas each comprise a feed connection, the feed connections being coupled to respective first ends of the said arms, wherein, the arrangement is configured such that each feed connection is isolated from the or each feed connection at the operating frequency.

3. The arrangement according to claim 2 wherein each arm comprises a phase-shifting element for effecting a 90° phase-shift between its ends at the operating frequency, the combining circuit further comprising a cancelling resistance interconnecting the or each respective pair of feed connections which, in conjunction with the phase-shifting elements, isolates each feed connection from the other feed connection of the respective pair.

4. The arrangement according to claim 2, wherein each arm comprises an impedance transformation element for stepping up the impedance presented by the respective antenna and any interposed network at the feed connection of the antenna, the combining circuit further comprising a cancelling resistance interconnecting the or each respective pair of feed connections which, in conjunction with the impedance transformation elements, isolates each feed connection from the other feed connection of the respective pair.

5. The arrangement according to claim 3, wherein each said element comprises a quarterwave transmission line section and the quarterwave transmission line sections are quarterwave microstrip transmission lines.

6. The arrangement according to claim 5, wherein each said microstrip transmission line has a characteristic impedance of about $\sqrt{2}$ times the output impedance of the combining circuit.

7. The arrangement according to claim 1, wherein the antennas are oriented with respect to each other such that their respective near fields combine constructively in a space between the antennas.

8. The arrangement according to claim 2, wherein the arrangement comprises two antennas, the combining circuit comprising two arms, and a single resistive component connected between the feed connection of one of the antennas and the feed connection of the other of the antennas.

9. The arrangement according to claim 1, wherein the antennas are cylindrical and are positioned such that the axis of each antenna is parallel to the axis of each of the other antennas and end surfaces of the said antennas lie in substantially the same planes.

10. The arrangement according to claim 9, wherein the cylindrical surfaces of the antennas between 0.05 λ and 0.20 λ apart, where λ is the wavelength in air at the operating frequency.

11. The arrangement according to claim 10, wherein the said antenna elements of each antenna comprise conductive helical tracks each extending over the cylindrical surface from one end surface of the cylindrical core in the direction of the other end surface.

12. The arrangement according to claim 11, wherein the antenna element structure of each antenna further comprises a linking conductor encircling the core and interconnecting ends of the said antenna elements which are at locations spaced from the said one end surface of the core.

13. The arrangement according to claim 12, wherein the feed connection of each antenna is at a proximal end of the core and coaxial transmission line connects the feed connection to the antenna elements at a distal end of the core.

14. The arrangement according to claim 13, wherein the coaxial transmission line of each antenna has an inner conductor and an outer conductor, the inner conductor is coupled to a first pair of the antenna elements and the outer conductor is coupled to a second pair of elements, and wherein the antennas are oriented such that the first pair of antenna elements of each of antennas are directed towards the other of the antennas.

15. The arrangement according to claim 14, further comprising a half-wave delay line, which is connected between the feed connection of one of the antennas and the associated arm of the combining circuit.

16. A mobile terminal comprising the antenna arrangement of claim 1.

17. An antenna arrangement for a portable terminal, comprising:

at least two antennas each resonant at a common operating frequency, and a circuit arranged to split an input signal into substantially identical split signals and to feed the split signals to each of the antennas, wherein each antenna comprises:

an electrically insulative core of a solid material having a relative dielectric constant greater than 5, and a three-dimensional antenna element structure including at least a pair of elongate conductive antenna elements disposed on or adjacent a surface of the core.

18. The antenna arrangement according to claim 17, having a pair of said antennas, the antennas being substantially identical helical antennas each having a respective central axis with the two axes parallel and spaced apart, the two antennas having the same axial position as each other, wherein a rotational position of the antennas about their respective axes differ by 180 degrees.

* * * * *